US010947702B2

(12) United States Patent
Takahashi et al.

(10) Patent No.: US 10,947,702 B2
(45) Date of Patent: Mar. 16, 2021

(54) HYDRAULIC DRIVE SYSTEM FOR ELECTRICALLY DRIVEN HYDRAULIC WORK MACHINE

(71) Applicant: Hitachi Construction Machinery Tierra Co., Ltd., Koka (JP)

(72) Inventors: Kiwamu Takahashi, Moriyama (JP); Takeshi Ishii, Hino-Cho (JP); Taihei Maehara, Koka (JP)

(73) Assignee: Hitachi Construction Machinery Tierra Co., Ltd, Koka (JP)

( * ) Notice: Subject to any disclaimer, the term of this patent is extended or adjusted under 35 U.S.C. 154(b) by 0 days.

(21) Appl. No.: 16/650,635

(22) PCT Filed: Sep. 5, 2018

(86) PCT No.: PCT/JP2018/032936
§ 371 (c)(1),
(2) Date: Mar. 25, 2020

(87) PCT Pub. No.: WO2020/049668
PCT Pub. Date: Mar. 12, 2020

(65) Prior Publication Data

US 2020/0224389 A1 Jul. 16, 2020

(51) Int. Cl.
*E02F 9/22* (2006.01)
*E02F 9/20* (2006.01)
*F15B 11/16* (2006.01)

(52) U.S. Cl.
CPC ..... *E02F 9/2246* (2013.01); *E02F 9/2095* (2013.01); *E02F 9/2221* (2013.01); (Continued)

(58) Field of Classification Search
None
See application file for complete search history.

(56) References Cited

U.S. PATENT DOCUMENTS

2005/0198950 A1 9/2005 Nissen et al.
2011/0238264 A1* 9/2011 Wu ..... F04B 17/03 701/36

(Continued)

FOREIGN PATENT DOCUMENTS

JP 2011-94451 A 5/2011
JP 2014-194120 A 10/2014

(Continued)

OTHER PUBLICATIONS

International Search Report (PCT/ISA/210) issued in PCT Application No. PCT/JP2018/032936 dated Dec. 11, 2018 with English translation (five (5) pages).

(Continued)

*Primary Examiner* — Abiy Teka
*Assistant Examiner* — Matthew Wiblin
(74) *Attorney, Agent, or Firm* — Crowell & Moring LLP

(57) ABSTRACT

In a hydraulic drive system for an electrically driven hydraulic work machine that executes flow rate control of a hydraulic pump by controlling a rotation speed of an electric motor to drive a hydraulic pump to supply a hydraulic fluid to a plurality of actuators, and power consumed by the electric motor reliably limited within a range of preset maximum allowable power without unnecessary degradation of responsiveness of the electric motor. To this end, a controller includes a maximum angular acceleration limitation section (allowable rate computation section and rate limitation section), computes hydraulic power consumed by a main pump, computes a maximum angular acceleration allowed for an electric motor on the basis of a magnitude of the hydraulic power and a preset maximum allowable power consumable by the electric motor, and limits an angular acceleration of the electric motor not to exceed the maximum angular acceleration.

5 Claims, 7 Drawing Sheets

(52) U.S. Cl.
CPC ..... *E02F 9/2235* (2013.01); *F15B 11/165* (2013.01); *E02F 9/2228* (2013.01); *F15B 2211/20515* (2013.01); *F15B 2211/20546* (2013.01); *F15B 2211/251* (2013.01)

(56) References Cited

U.S. PATENT DOCUMENTS

| | | | | |
|---|---|---|---|---|
| 2012/0253610 | A1* | 10/2012 | Anders | B60K 6/12 701/50 |
| 2012/0303227 | A1 | 11/2012 | Nakamura | |
| 2013/0213026 | A1* | 8/2013 | Yamamoto | F04B 49/002 60/327 |
| 2014/0227104 | A1* | 8/2014 | Takahashi | E02F 9/207 417/42 |
| 2017/0361845 | A1* | 12/2017 | Sharp | B60W 10/10 |
| 2019/0084568 | A1* | 3/2019 | Carlson | E02F 9/2246 |

FOREIGN PATENT DOCUMENTS

| | | | |
|---|---|---|---|
| WO | WO 2011/105415 | A1 | 9/2011 |
| WO | WO 2013/058326 | A1 | 4/2013 |

OTHER PUBLICATIONS

Japanese-language Written Opinion (PCT/ISA/237) issued in PCT Application No. PCT/JP2018/032936 dated Dec. 11, 2018 (four (4) pages).

* cited by examiner

HYDRAULIC DRIVE SYSTEM FOR ELECTRICALLY DRIVEN HYDRAULIC WORK MACHINE

TECHNICAL FIELD

The present invention relates to a hydraulic drive system for an electrically driven hydraulic work machine such as a hydraulic excavator that use an electric motor to drive a hydraulic pump to execute various types of work, and in particular, to a hydraulic drive system for an electrically driven hydraulic work machine that controls a rotation speed of the electric motor to control the flow rate of the hydraulic pump.

BACKGROUND ART

Electrically driven hydraulic work machines such as hydraulic excavators that use an electric motor to drive a hydraulic pump to cause a plurality of actuators to execute various types of work are utilized in environments in which discharge of exhaust gas is not preferable, for example, indoor and underground work environments in view of features of these machines typified by no emission of exhaust gas from an engine, low noise, and the like.

Patent Document 1 and Patent Document 2 describe known hydraulic drive systems for electrically driven hydraulic work machines as described above.

Patent Document 1 discloses, as a hydraulic drive system for an electrically driven hydraulic work machine, a technique in which a controller incorporates an algorithm controlling a rotation speed of the electric motor to execute load sensing control of the hydraulic pump.

Patent Document 2 proposes an electric swing control system including a through rate limitation section provided for an electric motor driving a swing structure of a work machine, the through rate limitation section limiting the amount of change in speed command for the electric motor, a through rate being set in the through rate limitation section such that, in a case where a demanded swing torque is high, precluding the electric motor from following the speed command, the amount of change (angular acceleration) in the speed command for the electric motor is limited, thus reducing the maximum change amount of the speed command.

PRIOR ART DOCUMENT

Patent Documents

Patent Document 1: WO 2013/058326
Patent Document 2: JP-2014-194120-A

SUMMARY OF THE INVENTION

Problems to be Solved by the Invention

According to the technique in Patent Document 1, the rotation speed control is executed on the electric motor to perform load sensing control, and thus the electric motor controls the rotation speed according to the demanded flow rate determined by an operation input from each operation lever. Accordingly, for example, in a case where each operation lever input is small and the demanded flow rate is low, the rotation speed of the electric motor is kept low.

Here, it is known that the hydraulic pump with a higher rotation speed increases stirring resistance or viscous resistance of hydraulic oil associated with components rotationally moving or reciprocating in the pump, thereby leading to reduced efficiency.

Thus, for an electrically driven hydraulic work machine in which the electric motor has a constant rotation speed and in which the displacement (tilting angle) of the hydraulic pump is controlled to control a delivery flow rate of the hydraulic pump, a high pump efficiency fails to be obtained.

In the technique in Patent Document 1, in a case where the operation lever input is small and the demanded flow rate is low, the rotation speed of the electric motor is kept low to increase the efficiency of the hydraulic pump, allowing suppression of energy consumption of a battery.

However, Patent Document 1 also has room for improvement as described below.

In Patent Document 1, the rotation speed control is executed on the electric motor to perform the flow rate control (load sensing control) on the hydraulic pump as described above. Thus, in a case where, in a lever neutral state with the rotation speed of the electric motor kept low, an operation lever corresponding to a certain actuator is suddenly operated to activate the actuator, the rotation speed of the electric motor rapidly increases to increase the delivery flow rate of the hydraulic pump. At this time, in the electric motor, generated is a torque against an inertia moment of a rotor of the electric motor, in addition to a torque for driving the hydraulic pump, and an excessive current may be generated in the electric motor. Such an excessive current generated significantly reduces the life of the battery. Additionally, in a case where power is supplied from a commercial power supply or an external battery for operation, the allowable power of the commercial power supply is exceeded to cut off a breaker or the life of the external battery is significantly impaired.

In light of these problems, the through rate limitation section as described in Patent Document 2 may be provided in the configuration in Patent Document 1 to limit the amount of change (angular acceleration) in rotation speed of the electric motor to prevent a rapid increase in rotation speed of the electric motor.

However, even in that case, the following problems are posed.

In Patent Document 1, the through rate set in the through rate limitation section in a case where a high demanded swing torque precludes the electric motor from following the speed command is a preset constant value and is not variable according to the magnitude of a hydraulic load on the hydraulic pump.

Thus, for example, in a case where the hydraulic pump has a low load pressure and a low delivery flow rate, a load torque attributed to the hydraulic load is low, and an excessive current is less likely to be generated in the electric motor even in a case where the load torque resulting from the inertia moment of the rotor of the electric motor is large. However, since the through rate is a preset constant value as described above, even in the above-described case, the amount of change in rotation speed of the electric motor is unnecessarily limited by the constant through rate. This may significantly impair responsiveness of the hydraulic pump (responsiveness of each actuator) to the flow rate control, leading to very uncomfortable feeling of an operator.

An object of the present invention is to provide a hydraulic drive system for an electrically driven hydraulic work machine, flow rate control of an hydraulic pump being executed by controlling the rotation speed of an electric motor to drive the hydraulic pump to supply a hydraulic fluid to a plurality of actuators, in which the amount of change in rotation speed of the electric motor is optimally adjusted according to the magnitude of load power consumed by the hydraulic pump thereby to reliably limit the power consumed by the electric motor within a range of preset maximum allowable power without unnecessarily degrading responsiveness of the electric motor.

Means for Solving the Problems

To solve the object, the present invention provides a hydraulic drive system for an electrically driven hydraulic work machine, the hydraulic drive system including an electric motor, a hydraulic pump driven by the electric motor, a plurality of actuators driven by a hydraulic fluid delivered from the hydraulic pump, a control valve device that distributes and feeds the hydraulic fluid delivered from the hydraulic pump to the plurality of actuators; and a controller that controls a rotation speed of the electric motor thereby to control a delivery flow rate of the hydraulic pump, wherein the controller is configured to compute a hydraulic power consumed by the hydraulic pump, compute a maximum angular acceleration allowed for the electric motor on a basis of a magnitude of the hydraulic power and a preset maximum allowable power consumable by the electric motor, and limit an angular acceleration of the electric motor not to exceed the maximum angular acceleration, and control the rotation speed of the electric motor.

In this manner, since the controller is configured to compute a maximum angular acceleration allowed for the electric motor on the basis of a magnitude of the hydraulic power and a preset maximum allowable power consumable by the electric motor, and limit an angular acceleration of the electric motor not to exceed the maximum angular acceleration, and control the rotation speed of the electric motor, even in a case where the hydraulic power fluctuates due to variation in load pressure applied to the hydraulic pump or the like, the angular acceleration of the electric motor is correspondingly limited, and thus the power consumed by the electric motor is reliably limited within a preset range of the maximum allowable power.

Additionally, in a case where the hydraulic power is low and the angular acceleration of the electric motor need not be limited, the angular acceleration of the electric motor (rotation speed increase rate) can be set to a larger value, and thus the rotation speed of the electric motor increases quickly and the plurality of actuators can be driven with excellent responsiveness.

Advantages of the Invention

According to the present invention, even in a case where the consumed power of the hydraulic pump driven by the electric motor fluctuates due to variation in load pressure applied to the hydraulic pump or the like, the angular acceleration of the electric motor is correspondingly limited, and thus the power consumed by the electric motor is reliably limited within the preset range of the maximum allowable power.

Additionally, in a case where the consumed power of the hydraulic pump is low and the power can be distributed to increase the rotation speed of the electric motor, the angular acceleration of the electric motor can be set to a larger value, and thus the rotation speed of the electric motor increases quickly and the plurality of actuators can be driven with excellent responsiveness.

MODES FOR CARRYING OUT THE INVENTION

Embodiments of the present invention will be described in accordance with the drawings.

—Structure—

Figure 1:
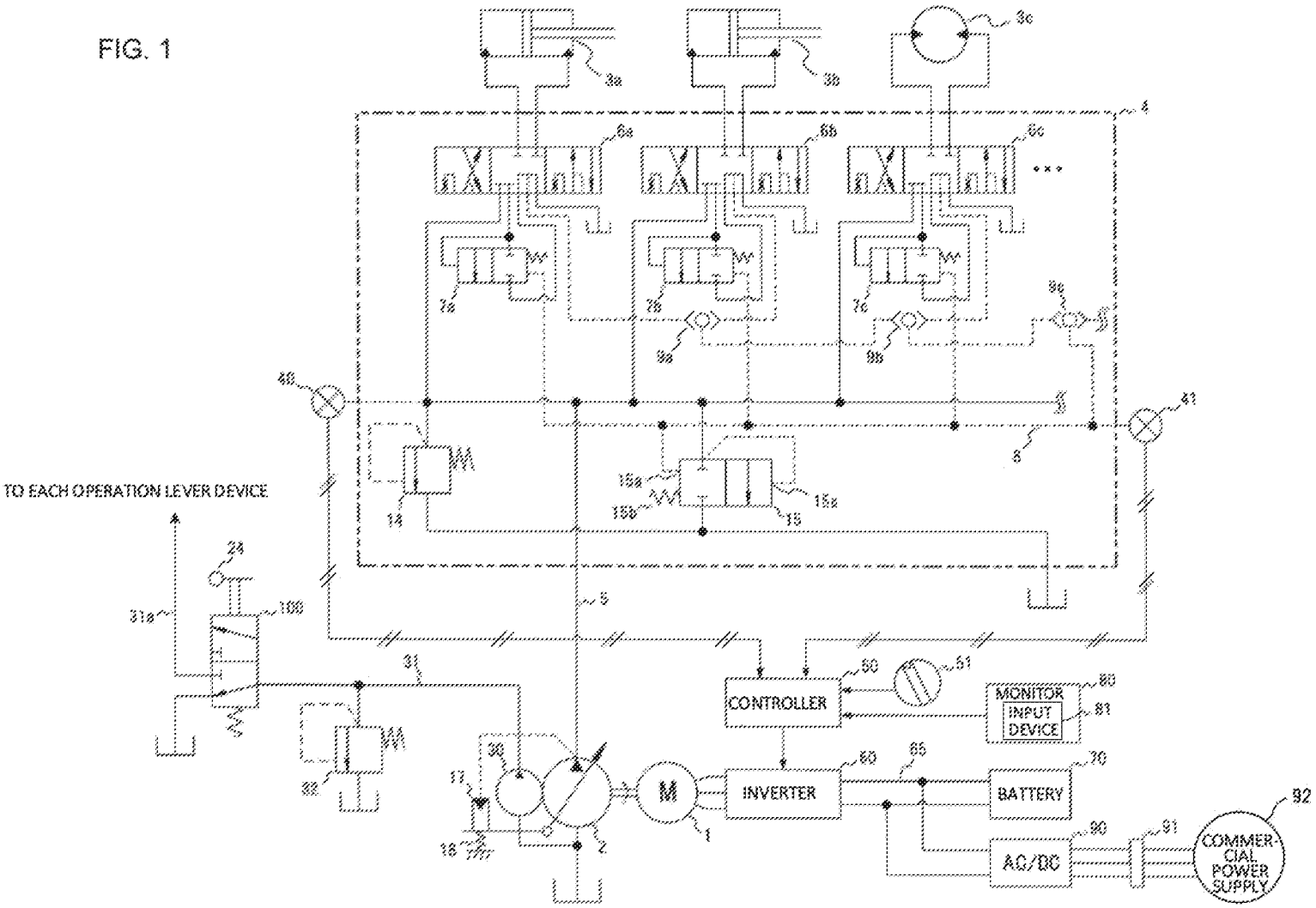
FIG. 1 is a diagram illustrating a hydraulic drive system for an electrically driven hydraulic work machine according to an embodiment of the present invention.

FIG. 1 is a diagram illustrating a hydraulic drive system for an electrically driven hydraulic work machine according to an embodiment of the present invention.

The hydraulic drive system according to the present embodiment includes an electric motor 1, a main pump 2 of a variable displacement type (hydraulic pump) and a pilot pump 30 of a fixed displacement type that are driven by the electric motor 1, a boom cylinder 3*a*, an arm cylinder 3*b*, a swing motor 3*c*, a bucket cylinder 3*d* (see FIG. 2), a swing cylinder (not shown), track motors 3*f* and 3*g* (see FIG. 2), and a blade cylinder 3*h* (see FIG. 2) corresponding to a plurality of actuators driven by a hydraulic fluid delivered from the main pump 2 of the variable displacement type, a hydraulic fluid supply line 5 through which the hydraulic fluid delivered from the main pump 2 of the variable displacement type is introduced to the plurality of actuators 3*a*, 3*b*, 3*c*, 3*d*, 3*f*, 3*g*, and 3*h*, and a control valve block (control valve device) 4 connected downstream to the hydraulic fluid supply line 5 and to which the hydraulic fluid delivered from the main pump 2 of the variable displacement type is introduced. The "actuators 3*a*, 3*b*, 3*c*, 3*d*, 3*f*, 3*g*, and 3*h*" are hereinafter simply referred to as the "actuators 3*a*, 3*b*, 3*c*, . . . ."

The control valve block 4 is included in a control valve device distributing and feeding, to the plurality of actuators 3*a*, 3*b*, 3*c*, . . . , the hydraulic fluid delivered from the main pump 2 (hydraulic pump), and the following are disposed in the control valve block 4: a plurality of directional control valves 6*a*, 6*b*, 6*c*, . . . for controlling the plurality of actuators 3*a*, 3*b*, 3*c*, . . . , and a plurality of pressure compensating valves 7*a*, 7*b*, 7*c*, . . . each located downstream of a meter-in opening of a corresponding one of the plurality of directional control valves 6*a*, 6*b*, 6*c*, . . . . The pressure compensating valves 7*a*, 7*b*, 7*c*, . . . are each provided with a spring biasing a spool of a corresponding one of the pressure compensating valves 7*a*, 7*b*, 7*c*, . . . in a closing direction. A downstream pressure of the meter-in opening of each of the plurality of directional control valves 6*a*, 6*b*, 6*c*, . . . is introduced to a side at which the spool of the corresponding one of the pressure compensating valves 7*a*, 7*b*, 7*c*, . . . is biased in an opening direction. A maximum load pressure Plmax on each of the plurality of actuators 3*a*, 3*b*, 3*c*, . . . , described below, is introduced to a side at which the spool of the corresponding one of the pressure compensating valves 7*a*, 7*b*, 7*c*, . . . is biased in the closing direction.

The plurality of directional control valves 6*a*, 6*b*, 6*c*, . . . and the plurality of pressure compensating valves 7*a*, 7*b*, 7*c*, . . . are included in the control valve device distributing and feeding, to the plurality of actuators 3*a*, 3*b*, 3*c*, . . . , the hydraulic fluid delivered from the main pump 2.

Additionally, the control valve block 4 internally includes a relief valve 14 located downstream of the hydraulic fluid supply line 5 to discharge the hydraulic fluid in the hydraulic fluid supply line 5 into a tank in a case where the pressure of the hydraulic fluid supply line 5 (delivery pressure of the main pump 2) is equal to or higher than a predefined set pressure, and an unloading valve 15 also located downstream of the hydraulic fluid supply line 5 to discharge the hydraulic fluid in the hydraulic fluid supply line 5 into the tank in a case where a differential pressure between the pressure of the hydraulic fluid supply line 5 (delivery pressure of the main pump 2) and the maximum load pressure Plmax is equal to or higher than a set pressure.

Furthermore, in the control valve block 4, shuttle valves 9*a*, 9*b*, 9*c*, . . . are disposed each of which is connected to a load pressure sense port of a corresponding one of the plurality of directional control valves 6*a*, 6*b*, 6*c*, . . . . The shuttle valves 9*a*, 9*b*, 9*c*, . . . are connected in a tournament form, and the highest load pressure is sensed in the uppermost shuttle valve 9*c* and output to a hydraulic fluid line 8. The shuttle valves 9*a*, 9*b*, 9*c*, . . . are included in a maximum load pressure sensor sensing the maximum load pressure of the plurality of actuators 3*a*, 3*b*, 3*c*, . . . .

The unloading valve 15 includes a pressure receiving section 15*a* through which the maximum load pressure of the plurality of actuators 3*a*, 3*b*, 3*c*, . . . is introduced in a direction in which the unloading valve 15 is closed, a spring 15*b* provided in a direction in which the unloading valve 15 is closed, and a pressure receiving section 15*c* through which the pressure of the hydraulic fluid supply line 5 (delivery pressure of the main pump 2) is introduced in a direction in which the unloading valve 15 is opened.

The main pump 2 of the variable displacement type includes a regulator piston 17 adjusting the displacement (tilting angle) of the main pump 2 and a spring 18 oriented to face the regulator piston 17. The main pump 2 of the variable displacement type is configured to execute horsepower control in which the pressure of the hydraulic fluid supply line 5 is introduced to the regulator piston 17 and in which, when the pressure of the hydraulic fluid supply line 5 increases, the tilting of the main pump 2 of the variable displacement type is reduced to decrease suction power of the main pump 2 of the variable displacement type.

A hydraulic fluid supply line 31 of the pilot pump 30 is provided with a pilot relief valve 32 keeping the pressure of the hydraulic fluid supply line 31 constant and forming a pilot hydraulic fluid pressure source in the hydraulic fluid supply line 31, and a selector valve 100 switched to determine whether to feed the pressure of the hydraulic fluid supply line 31 to a plurality of pilot valves (not illustrated) for actuating the plurality of directional control valves 6*a*, 6*b*, 6*c*, . . . . The plurality of pilot valves (not illustrated) are each built in a plurality of operation lever devices including operation lever devices 124A and 124B (see FIG. 2) for the boom cylinder 3*a*, the arm cylinder 3*b*, the bucket cylinder 3*d*, and the swing cylinder (not shown). Operation of an operation lever of any operation lever device actuates the corresponding pilot valve to generate an operation pilot pressure for actuating the corresponding one of the plurality of directional control valves 6*a*, 6*b*, 6*c*, . . . , using, as a pilot primary pressure, the hydraulic fluid introduced from the hydraulic fluid supply line 31. By operating a gate lock lever 24 provided in a cab 108 (see FIG. 2) of a construction machine such as a hydraulic excavator, the selector valve 100 is switched to determine whether the pressure of the hydraulic fluid supply line 31 is fed to the plurality of pilot valves (not illustrated) as the pilot primary pressure or the pilot primary pressure fed to the pilot valves is discharged into the tank.

Additionally, the hydraulic drive system according to the present embodiment includes a controller 50, a reference rotation speed indication dial 56 indicating a reference rotation speed, an inverter 60 for controlling the rotation speed of the electric motor, a battery 70 connected to the inverter 60 via a DC power supply line 65 to supply DC power to the inverter 60, a monitor 80 including a built-in input device 81 setting maximum allowable power that can be consumed by the electric motor 1, an AC/DC converter 90 connected to the inverter 60 via the DC power supply line 65, and a connector 91 connected to an AC/DC converter 90. The AC/DC converter 90 converts, into DC power, AC power supplied from the commercial power supply 92, and supplies the DC power to the inverter 60.

Additionally, the hydraulic drive system according to the present embodiment includes a pressure sensor 40 connected to the hydraulic fluid supply line 5 to sense a pump pressure Pps corresponding to the delivery pressure of the main pump 2, and a pressure sensor 41 connected to the hydraulic fluid line 8 through which the maximum load pressure is introduced, to sense a maximum load pressure Pplmax. Pressure signals from the pressure sensors 40 and 41 are input to the controller 50 along with a reference rotation speed signal from the reference rotation speed indication dial 51 and a signal for the maximum allowable power from the input device 81.

Figure 2:
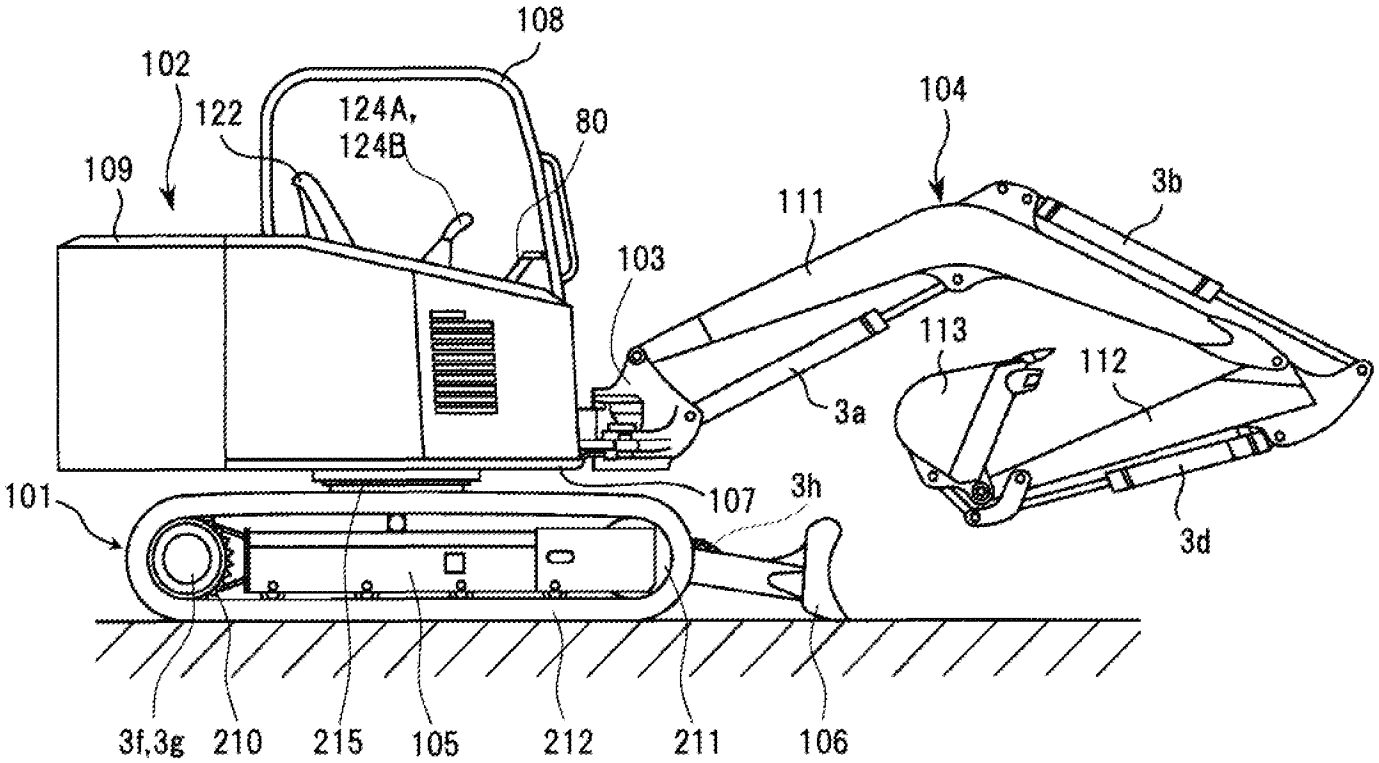
FIG. 2 is a diagram illustrating an appearance of a hydraulic excavator corresponding to an example of the electrically driven hydraulic work machine in which the hydraulic drive system according to the present embodiment is mounted.

FIG. 2 illustrates an appearance of a hydraulic excavator as an example of the electrically driven hydraulic work machine in which the hydraulic drive system according to the present embodiment is mounted.

The hydraulic excavator includes an upper swing structure 102, a lower track structure 101, and a swinging front work device 104, and the front work device 104 includes a boom 111, an arm 112, and a bucket 113. The upper swing structure 102 and the lower track structure 101 are rotatably connected together via a swing wheel 215, and the upper swing structure 102 can be swung with respect to the lower track structure 101 by rotation of the swing motor 3*c*. A swing post 103 is attached to a front portion of the upper swing structure, and the front work device 104 is vertically movably attached to the swing post 103. The swing post 103 can be rotated in a horizontal direction with respect to the upper swing structure 102 by extension and contraction of the swing cylinder (not shown), and the boom 111, the arm 112, and the bucket 113 of the front work device 104 can be rotated in a vertical direction by extension and contraction of the boom cylinder 3*a*, the arm cylinder 3*b*, and the bucket cylinder 3*d*. A blade 106 is attached to a center frame 105 of the lower track structure 101 and is caused to perform vertical operations by extension and contraction of an idler 211 and the blade cylinder 3*h*. The lower track structure 101 is caused to travel by rotating the track motors 3*f* and 3*g* to drive left and right crawlers 212 through drive wheels 210.

The upper swing structure 102 includes a battery mounting section 109 installed on a swing frame 107 and in which a battery 70 is mounted and the cab 108 also installed on the swing frame 107. The cab 108 is internally provided with an operator's seat 122, the operation lever devices 124A and 124B for the boom cylinder 3*a*, the arm cylinder 3*b*, the bucket cylinder 3*d*, and the swing motor 3*c*, the monitor 80, and the gate lock lever 24 (see FIG. 1).

Figure 3:
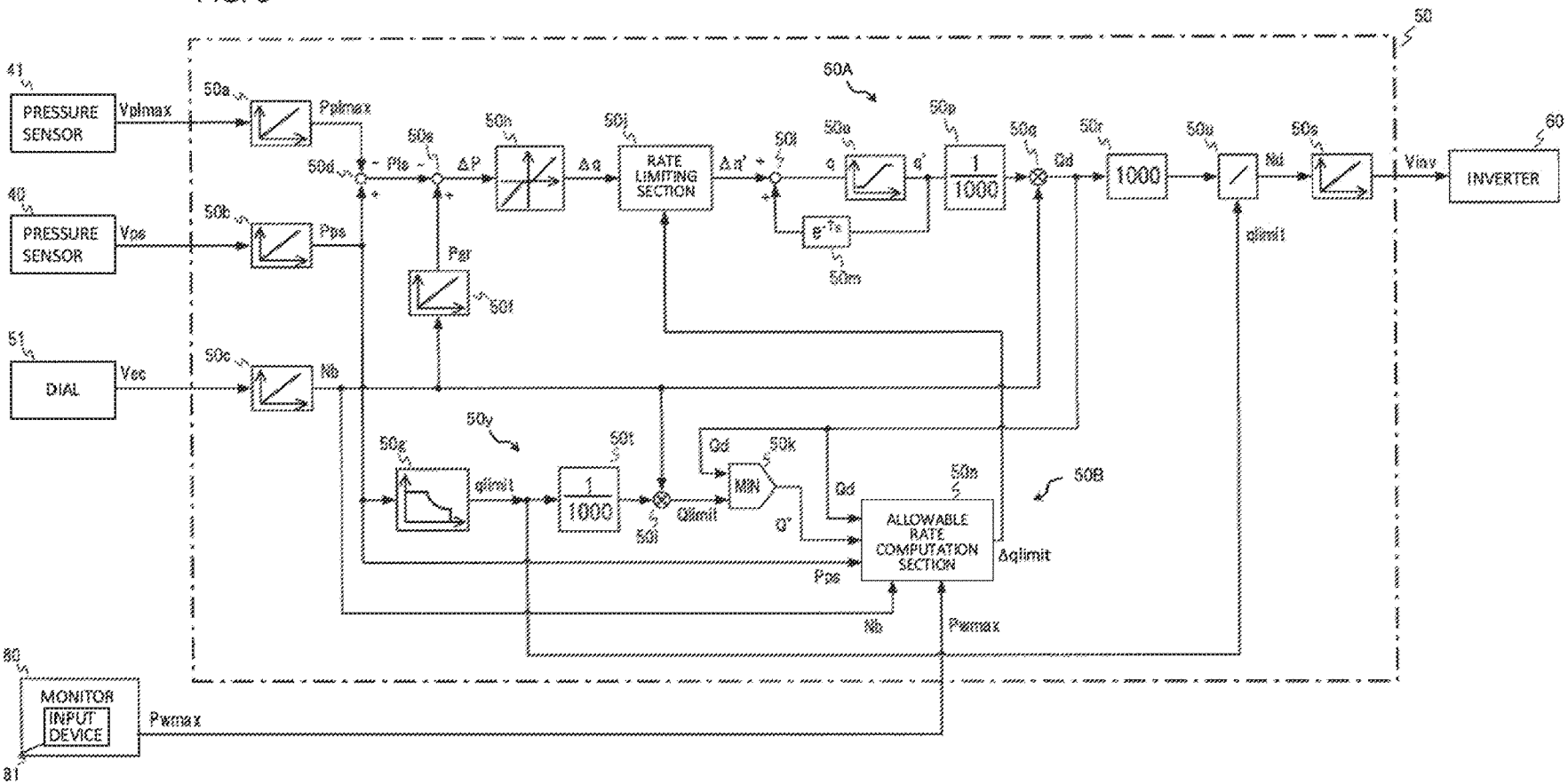
FIG. 3 is a functional block diagram illustrating contents of processing executed by a CPU of a controller according to the present embodiment.

FIG. 3 is a functional block diagram illustrating contents of processing executed by the CPU of the controller 50 according to the present embodiment.

In FIG. 3, signals Vplmax and Vps from the pressure sensors 41 and 40 are respectively converted into the maximum load pressure Pplmax and the pump pressure Pps via tables 50*a* and 50*b*, and the maximum load pressure Pplmax and the pump pressure Pps are sent to a differentiator 50*d*, and an LS differential pressure Pls (Pls=Pps−Pplmax) is computed.

Meanwhile, a signal Vec from the reference rotation speed indication dial 51 is converted into a reference rotation speed Nb via a table 50*c*, and a target LS differential pressure Pgr is computed via a table 50*f*. The LS differential pressure Pls and the target LS differential pressure Pgr are sent to the differentiator 50*e*, and a differential pressure deviation ΔP (ΔP=Pgr−Pls) is computed. The differential pressure deviation ΔP is a parameter representing excess or deficiency of the delivery flow rate required for the main pump 2. The differential pressure deviation ΔP is input to a table 50*h*, and a required amount of virtual displacement change of virtual displacement change (increase and decrease amount) Δq depending on the differential pressure deviation ΔP (excess or deficiency of the delivery flow rate) is computed.

The amount of virtual displacement change of virtual displacement change Δq is limited by a rate limitation section 50*j* on the basis of a maximum amount of virtual displacement change of virtual displacement change Δqlimit computed by an allowable rate computation section 50*n* described below, and the allowable rate computation section 50*n* outputs a limited amount of virtual displacement change of virtual displacement change Δq'.

Figure 4:
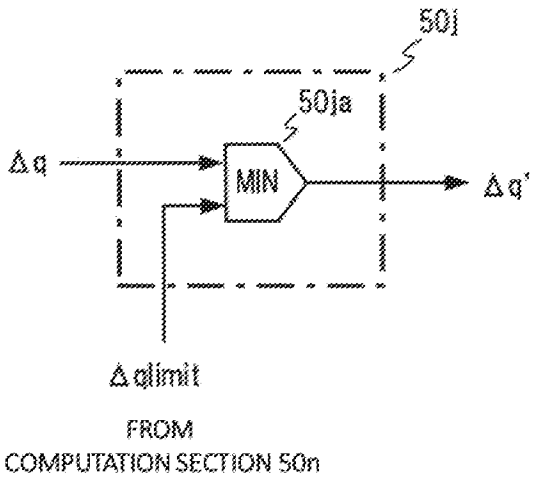
FIG. 4 is a diagram illustrating a functional block diagram of an allowable rate computation section according to the present embodiment.

FIG. 4 is a functional block diagram of the rate limitation section 50*j* according to the present embodiment.

The rate limitation section 50*j* includes a minimum-value selector 50*ja* which receives the amount of virtual displacement change of virtual displacement change Δq computed via the table 50*h* and the maximum amount of virtual displacement change of virtual displacement change Δqlimit computed by the allowable rate computation section 50*n*, and the rate limitation section 50*j* outputs the smaller of these amounts as the limited amount of virtual displacement change of virtual displacement change Δq'.

The limited amount of virtual displacement change Δq' is added, by a delay element 50*m* and an adder 501, to a limited virtual displacement q' described blow and obtained one control cycle before, and thus, a new virtual displacement q is computed. For the virtual displacement q, a minimum value/maximum value is limited by a limiter 50*o*, and the limited virtual displacement q' is computed. The above-described limited virtual displacement q' is multiplied by a gain 50*p*, and the resultant value, along with the above-described reference rotation speed Nb, is sent to a multiplier 50*q*, and a target flow rate Qd (Qd=q'×Nb/1000) is computed.

The target flow rate Qd is multiplied by a gain 50*r*, and the resultant value is divided by a displacement limit value qlimit described below, using a divider 50*u*. Thus, a target rotation speed Nd (Nd=Qd×1000/qlimit) of the electric motor 1 is computed. The target rotation speed Nd is converted into a command value Vinv via a table 50*s*, and Vinv is output to the inverter 60.

Meanwhile, the pressure of the hydraulic fluid supply line 5 converted via the table 50*b*, that is, the pump pressure Pps, is sent to a table 50*g*, in which the displacement limit value qlimit is computed. In the table 50*g*, properties are set that simulate horsepower control properties of the regulator piston 17 and spring 18 of the main pump 2 of the variable displacement type.

Figure 5:
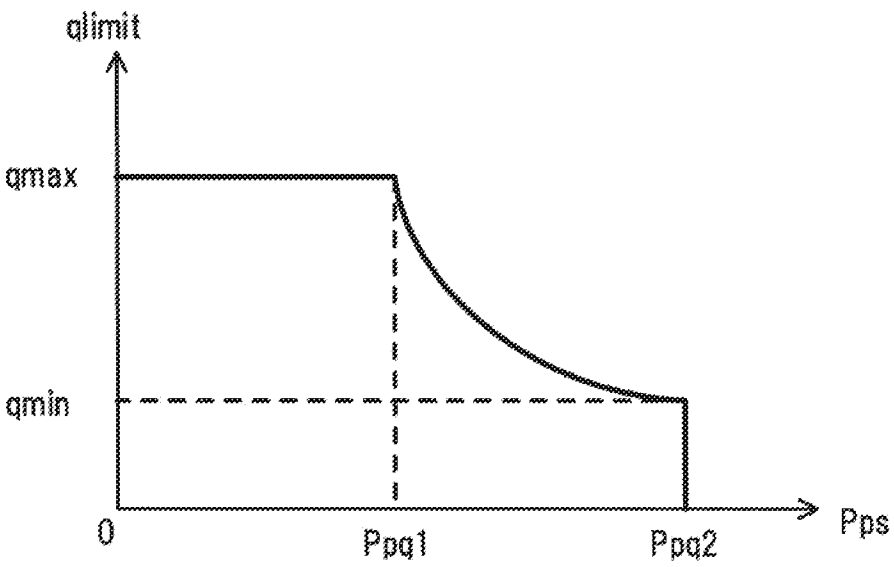
FIG. 5 is a diagram illustrating a horsepower control property set in a table.

FIG. 5 is a diagram illustrating the horsepower control properties set in the table 50*g*.

In FIG. 5, in a case where the pressure Pps of the hydraulic fluid supply line 5<Ppq1, the displacement limit value qlimit is equal to the physical maximum displacement qmax of the main pump 2 (qlimit=qmax). For Ppq1≤Pps<Ppq2, the displacement limit value qlimit decreases with pump pressure Pps increasing. For Pps=Ppq2, the displacement limit value qlimit reaches a minimum value qmin.

The displacement limit value qlimit computed via the table 50*g* is multiplied by a gain 50*t*, and the resultant value is multiplied by the above-described reference rotation speed Nb using a multiplier 50*i*, and thus, a maximum limit flow rate Qlimit is computed. The maximum limit flow rate Qlimit, along with the above-described target flow rate Qd, is input to a minimum value selector 50*k*, which selects and outputs the smaller of the maximum limit flow rate Qlimit and the target flow rate Qd as a limited flow rate Q'.

The limited flow rate Q' is an estimated value of the flow rate delivered by the main pump 2 driven by the electric motor 1 and on which horsepower control is executed by the regulator piston 17 and the spring 18. The table 50*g*, the gain 50*t*, the multiplier 50*i*, and the minimum value selector 50*k* function as a pump flow rate estimation section 50*y* estimating the flow rate actually delivered by the main pump 2.

The following are sent to the allowable rate computation section 50*n*: the limited flow rate Q' corresponding to a pump flow rate estimated value, the above-described target flow rate Qd, the above-described pump pressure Pps, the above-described reference rotation speed Nb, and a maximum allowable power Pwmax input by the input device 81 provided in the monitor 80. The maximum amount of virtual displacement change Δqlimit computed by the allowable rate computation section 50*n* is sent to the above-described rate limitation section 50*j*.

Figure 6:
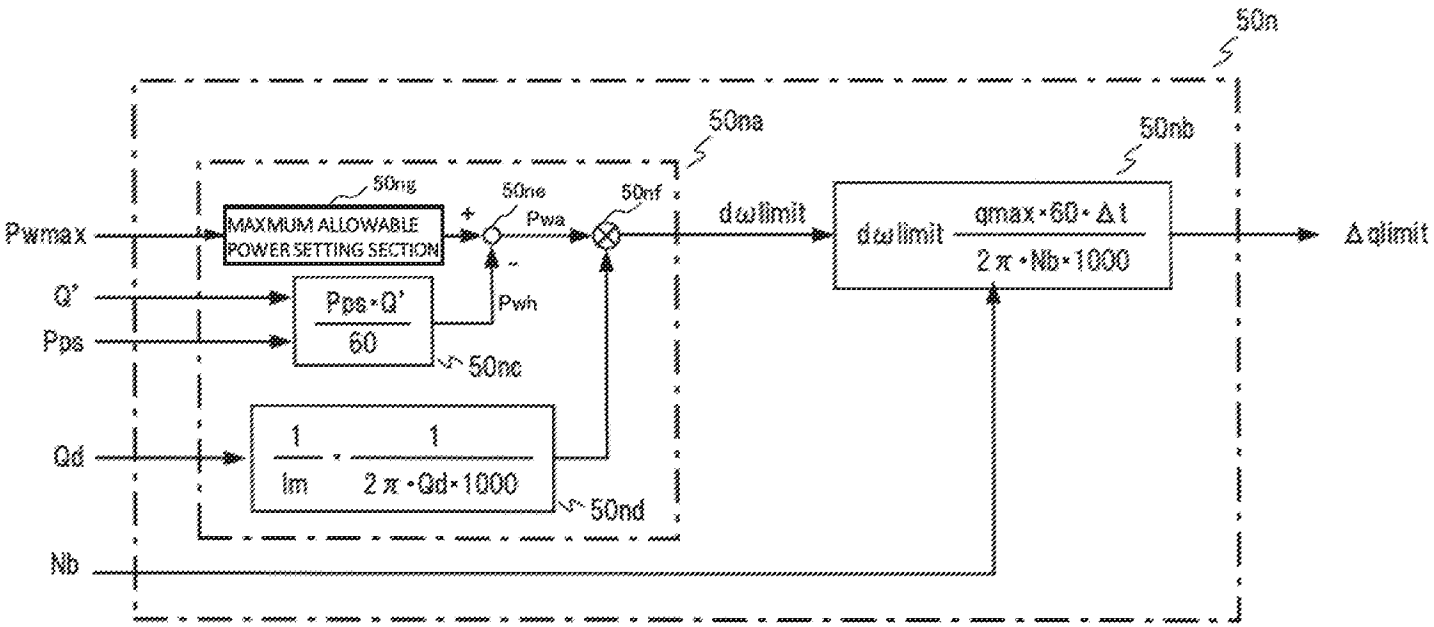
FIG. 6 is a functional block diagram of a rate limitation section according to the present embodiment.

FIG. 6 illustrates a functional block diagram of the allowable rate computation section 50*n* according to the present embodiment.

The allowable rate computation section 50*n* includes a maximum angular acceleration calculation section 50*na* and a maximum rate computation section 50*nb*.

The maximum allowable power Pwmax input by the input device 81, the limited flow rate Q', the pump pressure Pps, and the target flow rate Qd are sent to the maximum angular acceleration calculation section 50*na*, and a maximum angular acceleration dωlimit of the electric motor 1 is calculated.

The maximum angular acceleration calculation section 50*na* includes a hydraulic power computation section 50*nc*, a conversion parameter computation section 50*nd*, a subtractor 50*ne* and a multiplier 50*nf*, and a maximum allowable power setting section 50*ng*.

The maximum allowable power Pwmax input by the input device 81 is sent to the maximum allowable power setting section 50*ng*. The maximum allowable power Pwmax is stored in a memory (not illustrated), and the maximum allowable power Pwmax is set. The monitor 80 is configured to display a plurality of types of maximum allowable power Pwlimit depending on whether a power supply for the electric motor 1 is the battery 70 or the commercial power supply 92 and to allow a desired type of maximum allowable power Pwlimit to be selected by operation of the input device 81.

The limited flow rate Q' and the pump pressure Pps are sent to the hydraulic power computation section 50*nc*, and the hydraulic power computation section 50*nc* uses the limited flow rate Q' and the pump pressure Pps to execute calculation of Pps×Q'/60 to compute a hydraulic power Pwh consumed by the main pump 2. The subtractor 50*ne* subtracts the hydraulic power Pwh from the maximum allowable power Pwmax to compute an acceleration power Pwa that can be consumed for acceleration of the electric motor 1.

Figure 7:
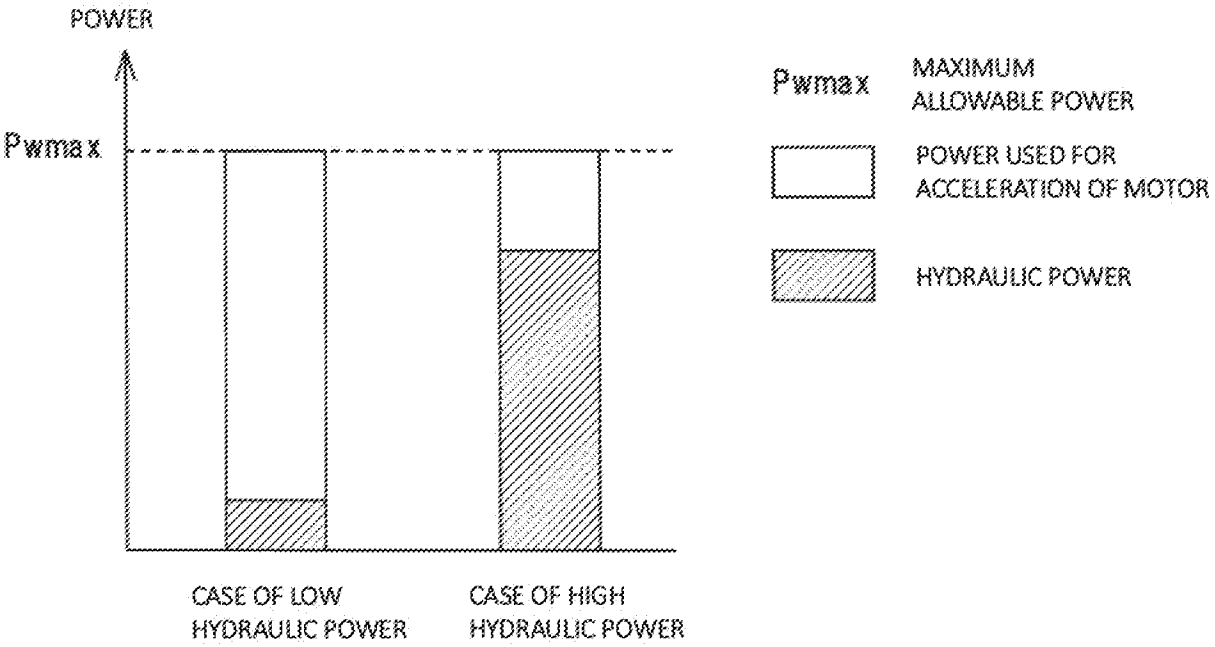
FIG. 7 is a diagram illustrating a concept of a method for computing power (allowable acceleration power) usable to accelerate an electric motor.

FIG. 7 illustrates a concept of a method for computing power that can be used for acceleration of the electric motor 1.

For example, in a case where the main pump 2 of the variable displacement type has a low delivery pressure and a low delivery flow rate and provides low hydraulic power, much of the maximum allowable power Pwmax can be used for acceleration of the electric motor 1 as illustrated in a bar graph on the left side of FIG. 7.

In contrast, in a case where the main pump 2 has a high delivery pressure and a high delivery flow rate and provides high hydraulic power, only a little of the maximum allowable power Pwmax can be used for acceleration of the electric motor 1 as illustrated in a bar graph on the right side of FIG. 7.

Based on such a concept, the hydraulic power computation section 50*nc* computes the hydraulic power Pwh of the main pump 2, and the subtractor 50*ne* subtracts the hydraulic power Pwh from the maximum allowable power Pwmax to compute the acceleration power Pwa that can be consumed for acceleration of the electric motor 1.

The target flow rate Qd is sent to the conversion parameter computation section 50*nd*, and the conversion parameter computation section 50*nd* calculates a conversion parameter 1/Im×1/(2π×Qd×1000) using the target flow rate Qd. Here, Im is an inertia moment of the rotor of the electric motor 1. The value of the conversion parameter is multiplied, in the multiplier 50*nf*, by the acceleration power Pwa that can be consumed for acceleration of the electric motor 1, and thus, the maximum angular acceleration dωlimit is computed. Specifically, the acceleration power Pwa that can be consumed for acceleration of the electric motor 1 is multiplied by 1/(2π×Qd×1000) to convert the acceleration power Pwa into a torque, and the torque is further multiplied by 1/Im to compute the maximum angular acceleration dωlimit allowed for the electric motor 1.

The maximum rate computation section 50*nb* uses the maximum displacement qmax of the main pump 2 of the variable displacement type, one control cycle time Δt, and the reference rotation speed Nb to compute the allowable maximum amount of virtual displacement change Δqlimit from the maximum angular acceleration dωlimit that is the calculation result from the maximum angular acceleration calculation section 50*na*.

Here, qmax is the physical maximum displacement of the main pump 2 of the variable displacement type as described above, and Δt is one control cycle time of the controller 50.

The maximum displacement qmax of the main pump 2 of the variable displacement type, the one control cycle time Δt, and the reference rotation speed Nb are constant values, and none of these values are updated every control cycle unless the operator operates the reference rotation speed indication dial. Thus, the maximum amount of virtual displacement change Δqlimit also fluctuates in proportion to the magnitude of the allowable maximum angular acceleration dωlimit.

—Correspondence to Claims—

The tables 50*a*, 50*b*, 50*c*, 50*f*, 50*h*, and 50*s*, the differentiators 50*d* and 50*e*, the delay element 50*m*, the adder 501, the limiter 50*o*, the gains 50*p* and 50*r*, the multiplier 50*q*, and the divider 50*u* provide an electric motor rotation speed control section 50A, and in the electric motor rotation speed control section 50A, the controller is configured to calculate a required amount of virtual displacement change Δq of the main pump 2 depending on the excess or deficiency of the delivery flow rate of the main pump 2 (hydraulic pump).

The pump flow rate estimation section including the table 50*g*, the gain 50*t*, the multiplier 50*i*, and the minimum value selector 50*k*, the allowable rate computation section 50*n*, and the rate limitation section 50*j* provide a maximum angular acceleration limitation section 50B, and in the maximum angular acceleration limitation section 50B, the controller 50 is configured to compute the hydraulic power Pwh consumed by the main pump 2 (hydraulic pump), compute the maximum angular acceleration dωlimit allowed for the electric motor 1 on the basis of the magnitude of the hydraulic power and the preset maximum allowable power Pwmax consumable by the electric motor 1, and limit the angular acceleration of the electric motor 1 not to exceed the maximum angular acceleration dωlimit, and control the rotation speed of the electric motor.

Additionally, in the present embodiment, in the maximum angular acceleration limitation section 50B, the controller 50 is configured to subtract, from the maximum allowable power Pwmax, the hydraulic power Pwh consumed by the main pump 2 to compute the allowable acceleration power Pwa consumable for acceleration by the electric motor 1 and compute the maximum angular acceleration dωlimit on the basis of the allowable acceleration power Pwa.

Furthermore, in the maximum angular acceleration limitation section 50B, the controller 50 is configured to compute the maximum amount of virtual displacement change Δqlimit allowed for the main pump 2 from the maximum angular acceleration dωlimit allowed for the electric motor 1, and limit the required amount of virtual displacement change Δq of the main pump 2 not to exceed the maximum amount of virtual displacement change Δqlimit thereby to limit the angular acceleration of the electric motor 1 not to exceed the maximum angular acceleration dωlimit, and control the rotation speed of the electric motor.

Also, in the present embodiment, in the electric motor rotation speed control section 50A, the controller 50 is configured to calculate the differential pressure deviation ΔP between the target differential pressure in load sensing control (target LS differential pressure Pgr) and the differential pressure (LS differential pressure Pls) between the delivery pressure of the main pump 2 (pump pressure Pps) and the maximum load pressure Pplmax on the plurality of actuators 3*a*, 3*b*, 3*c*, . . . , calculate the required amount of virtual displacement change Δq of the main pump 2 on the basis of the differential pressure deviation ΔP, and execute load sensing control to make the delivery pressure of the main pump 2 higher than the maximum load pressure by the target differential pressure. In the maximum angular acceleration limitation section 50B, the controller 50 is configured to limit the required amount of virtual displacement change Δq of the main pump 2 calculated on the basis of the differential pressure deviation ΔP not to exceed the maximum amount of virtual displacement change Δqlimit.

—Actuation—

Actuation of the hydraulic drive system according to the present embodiment as described above will be described.

DC power supplied from the battery 70 and DC power supplied through conversion of AC power by the AC/DC converter 90 via the connector 91 from the commercial power supply 92 are supplied, via the DC power supply line 65, to the inverter 60 driving the electric motor 1.

The maximum allowable power Pwlimit from the input device 81 built in the monitor 80 is input to the controller 50 and preset in the maximum allowable power setting section 50*ng*.

In a case where the power supply for the electric motor 1 is the battery 70, the maximum allowable power Pwlimit is set to prevent the life of the battery from being shortened by an overcurrent in consideration of the displacement of the battery 70. Additionally, in a case where the power supply for the electric motor 1 is the commercial power supply 92, the maximum allowable power Pwlimit is set to prevent a breaker from being cut off in consideration of the allowable power of the commercial power supply 92.

An input from the reference rotation speed indication dial 51 is converted into the reference rotation speed Nb via the table 50*c* of the controller 50, and the reference rotation speed Nb is converted into the target LS differential pressure Pgr via the table 50*f*.

The reference rotation speed Nb is intended to set a maximum value of the target rotation speed Nd of the electric motor 1, and the maximum speed of each actuator can be adjusted according to the magnitude of the reference rotation speed Nb. That is, the reference rotation speed Nb may be set to a large value in a case where work focusing on the speed is executed and may be set to a small value in a case where the work focuses on fine operability.

The target LS differential pressure Pgr is set to increase with an increase of the reference rotation speed Nb as a result of input of the reference rotation speed indication dial 51.

The hydraulic fluid delivered from the pilot pump 30 of the fixed displacement type is fed to the hydraulic fluid supply line 31 of the pilot pump 30, and the pilot relief valve 32 causes a pilot primary pressure Ppi0 to be generated in the hydraulic fluid supply line 31.

The pilot primary pressure Ppi0 is fed to each of the pilot valves of all the operation lever devices including the operation lever devices 124A and 124B, via the selector valve 100 switched and actuated by the gate lock lever 24.

(a) In Case where all Operation Levers are Neutral

In a case where the operation levers of all the operation lever devices are neutral, all the pilot valves built in the operation lever devices are neutral, and all the directional control valves 6*a*, 6*b*, 6*c*, . . . are kept neutral.

Since all the directional control valves 6*a*, 6*b*, 6*c*, . . . are neutral, a tank pressure as a load pressure of each of the actuators 3*a*, 3*b*, 3*c*, . . . is introduced to the unloading valve 15 and pressure sensor 41 via the shuttle valves 9*a*, 9*b*, 9*c* . . . as the maximum load pressure Pplmax.

The unloading valve 15 is opened to discharge the hydraulic fluid in the hydraulic fluid supply line 5 into the tank when the pressure of the hydraulic fluid supply line 5 is equal to or higher than a pressure determined by the spring 15*b* and the maximum load pressure Pplmax. Thus, in a case where the maximum load pressure Pplmax is the tank pressure as described above, the corresponding set pressure is equal to the pressure predetermined by the spring 15*b*, and the pressure of the hydraulic fluid supply line 5 is maintained at the pressure preset by the spring 15*b*.

Here, the pressure set by the spring 15*b* is set slightly higher than the target LS differential pressure Pgr calculated via the table 50*f* when the reference rotation speed Nb is maximized.

Meanwhile, the pressure Pps of the hydraulic fluid supply line 5 is introduced to the pressure sensor 40 connected to the hydraulic fluid supply line 5 and then to the controller 50 along with the above-described maximum load pressure Pplmax.

In a case where all the operation levers are neutral, the differential pressure deviation ΔP (=Pgr−Pls) has a negative value because a relationship Pls>Pgr holds true between the above-described target LS differential pressure Pgr and the LS differential pressure Pls (=Pps−Pplmax=Pps) calculated by the differentiator 50*e*.

Since the differential pressure deviation ΔP has a negative value, the amount of virtual displacement change Δq calculated via the table 50*h* also has a negative value.

In a case where the amount of virtual displacement change Δq has a negative value, the amount of virtual displacement change Δq is smaller than the maximum amount of virtual displacement change Δqlmit which is an output from the allowable rate computation section 50*n*. The amount of virtual displacement change Δq is not limited by the maximum amount of virtual displacement change Δqlmit and is sent to the adder 501 as the limited amount of virtual displacement change Δq'. The adder 501 adds the limited amount of virtual displacement change Δq' to the above-described limited virtual displacement q' obtained one cycle before, but the resultant value is limited to the minimum value by the limiter 50*o*, and the minimum value is calculated as a new limited virtual displacement q'.

As described above, in a case where all the operation levers are neutral, the amount of virtual displacement change Δq has a negative value, and the limited amount of virtual displacement q' is maintained at the minimum value.

The limited virtual displacement q' is multiplied by the gain 50*p*, and the resultant value is multiplied by the reference rotation speed Nb using the multiplier 50*q*. The value resulting from the multiplication is further multiplied by the gain 50*r*, and the resultant value is divided by the displacement limit value qlimit using the divider 50*u*, thus computing the target rotation speed Nd. However, as described above, in a case where all the operation levers are neutral, the limited virtual displacement q' is maintained at the minimum value, and thus, the target rotation speed Nd is also maintained at the minimum value (minimum rotation speed).

The target rotation speed Nd is converted into the command value Vinv for the inverter 60 via the table 50*s*, and the command value Vinv is output to the inverter 60.

In accordance with the command value Vinv, the inverter 60 controls and makes the rotation speed of the electric motor 1 equal to the target rotation speed Nd (minimum rotation speed).

(b) In Case where Optional Operation Lever is Operated

In a case where, among the plurality of actuators 3*a*, 3*b*, 3*c*, 3*d*, 3*f*, 3*g*, and 3*h*, for example, the operation lever of the operation lever device 124A is operated in a boom raising direction, the pilot valve corresponding to the operation lever device 124A is operated to switch, to the boom raising direction, the directional control valve 6*a* for driving the boom cylinder 3*a*. Switching of the directional control valve 6*a* causes the load pressure of the boom cylinder 3*a* to be sensed via the shuttle valves 9*a*, 9*b*, 9*c* . . . as the maximum load pressure Pplmax, which is introduced to the unloading valve 15 and the pressure sensor 41.

A set pressure for the unloading valve 15 is set, by the spring 15*b* and maximum load pressure Pplmax, equal to the maximum load pressure Pplmax (load pressure of the boom cylinder 3*a*)+the value determined by the spring 15*b*. The unloading valve 15 interrupts the flow of the hydraulic fluid in the hydraulic fluid supply line 5, through a hydraulic line along which the hydraulic fluid is discharged into the tank until the pressure of the hydraulic fluid supply line 5 rises to the set pressure or higher.

In contrast, immediately after the pilot valve corresponding to the boom raising direction of the operation lever device 124A is operated, the pressure Pps of the hydraulic fluid supply line 5 is lower than the maximum load pressure Pplmax, that is, the load pressure of the boom cylinder 3*a*. Thus, in the controller 50, the LS differential pressure Pls (Pls=Pps−Pplmax) calculated by the differentiator 50*d* is Pls<0, and the differential pressure deviation ΔP (=Pgr−Pls) computed by the differentiator 50*e* has a positive value. Since the differential pressure deviation ΔP is positive, the amount of virtual displacement change Δq computed via the table 50*h* also has a positive value.

The amount of virtual displacement change Δq is limited to the maximum amount of virtual displacement change Δqlimit by the rate limitation section 50*j*, and the limited amount of virtual displacement change Δq is then added to the limited virtual displacement q' obtained one control cycle before by the adder 501. Furthermore, the resultant value is limited by the minimum value/maximum value, and a new limited virtual displacement q' is computed.

The limited virtual displacement q' is converted into the target rotation speed Nd by the gain 50*p*, the multiplier 50*q*, the gain 50*r*, and the divider 50*u*, and the target rotation speed Nd is output to the inverter 60 through the table 50*s* as the command value Vinv.

Since the amount of virtual displacement change Δq has a positive value as described above, the rotation speed of the electric motor 1 continues to increase until the LS differential pressure Pls is equal to the target LS differential pressure Pgr. When Pls=Pgr is reached, the rotation speed of the electric motor 1 is controlled to maintain the current state.

In this manner, the controller 50 controls the rotation speed of the main pump 2 of the variable displacement type to control the flow rate delivered from the main pump 2 of the variable displacement type to make the pump pressure Pps higher than the maximum load pressure Pplmax by the target LS differential pressure Pgr. In other words, the controller 50 executes what is called load sensing control.

Furthermore, the table 50*g*, having properties simulating horsepower control properties of the main pump 2, the gain 50*t*, and the multiplier 50*i* compute, from the pump pressure Pps and the reference rotation speed Nb, a maximum allowable flow rate Qlimit that can be actually delivered by the main pump 2. The minimum value selector 50*k* then selects the smaller of the maximum allowable flow rate Qlimit and the target flow rate Qd computed by the multiplier 50*q* as the limited flow rate Q', thus estimating the flow rate actually delivered by the main pump 2. The flow rate Q' is sent to the allowable rate computation section 50*n* along with the target flow rate Qd, the pump pressure Pps, and the reference rotation speed Nb. The allowable rate computation section 50*n* computes the maximum amount of virtual displacement change Δqlimit, and the rate limitation section 50*j* limits the amount of virtual displacement change Δq.

Here, as described above, the allowable rate computation section 50*n* subtracts the hydraulic power Pwh consumed by the main pump 2 of the variable displacement type, from the maximum allowable power Pwmax preset on the basis of an input from the input device 81, thus computing the acceleration power Pwa that can be consumed for acceleration by the electric motor 1, and the allowable rate computation section 50*n* uses the acceleration power Pwa to compute the maximum amount of virtual displacement change Δqlimit.

Thus, in a case where the hydraulic power Pwh consumed by the main pump 2 of the variable displacement type is low, the maximum amount of virtual displacement change Δqlimit has a sufficiently large value, preventing the rate limitation section 50*j* from limiting the virtual displacement Δq. Thus, the rotation speed of the electric motor 1 increases rapidly to cause load sensing control to be executed with high responsiveness.

In contrast, in a case where the hydraulic power Pwh consumed by the main pump 2 of the variable displacement type is high, the maximum amount of virtual displacement change Δqlimit has a small value, causing the rate limitation section 50*j* to limit the virtual displacement Δq. Thus, the rotation speed of the electric motor 1 increases slowly to cause load sensing control to be executed with low responsiveness.

—Advantages—

As described above, according to the present embodiment, the load sensing control of the main pump 2 of the variable displacement type is executed by controlling the rotation speed of the electric motor 1. Thus, in a case where required flow rate is low, compared to a configuration in which the load sensing control is executed by controlling the tilting of the main pump 2 of the variable displacement type at a constant rotation speed of the electric motor 1, the main pump 2 of the variable displacement type can be used in a lower rotation speed region in which stirring resistance and frictional resistance are low and efficiency is high, thereby allowing the power consumption of the battery 70 or the commercial power supply 92 to be kept low.

Additionally, even in a case where the hydraulic power consumed by the main pump 2 of the variable displacement type fluctuates, the angular acceleration of the electric motor 1 is correspondingly limited. Thus, the total power consumed by the electric motor 1 is reliably limited within the preset maximum allowable power.

Furthermore, in a case where the hydraulic power is low and the angular acceleration of the electric motor 1 need not be limited, the rotation speed of the electric motor 1 can be quickly increased to allow the load sensing control of the hydraulic pump to be executed with excellent responsiveness. Thus, compared to a configuration in which the angular acceleration of the electric motor 1 is always controlled to a constant value, the plurality of actuators can be driven with excellent responsiveness, thereby allowing uncomfortable feeling of the operator to be minimized and secure excellent operability.

—Other—

Various modifications can be made to the above-described embodiment within the scope of the present invention.

For example, in the above-described embodiment, the required amount of virtual displacement change Δq of the main pump 2 is calculated depending on the excess or deficiency of the delivery flow rate of the main pump 2, and the required amount of virtual displacement change of the main pump 2 is limited and prevented from exceeding the maximum amount of virtual displacement change Δqlimit to limit and prevent the angular acceleration of the electric motor 1 from exceeding the maximum angular acceleration dωlimit. However, the angular acceleration of the electric motor 1 may be computed from the amount of change of the target rotation speed Nd of the electric motor 1, and may directly be controlled and prevented from exceeding the maximum angular acceleration dωlimit.

Additionally, in the above-described embodiment, the algorithm for the load sensing control is applied to the control of the electric motor rotation speed by the controller 50 to compute the differential pressure deviation ΔP of the load sensing control as a parameter representing the excess or deficiency of the delivery flow rate required for the main pump 2, and the required amount of virtual displacement change Δq of the main pump 2 is calculated from the differential pressure deviation ΔP. However, to the control of the electric motor rotation speed by the controller 50, an algorithm for what is called positive control may be applied that computes the sum of the required flow rates from all the operation lever devices including the operation lever devices 124A and 124B and that increases the delivery flow rate of the main pump 2 according to the sum of the required flow rates. Thus, a flow rate deviation between the sum of the required flow rates in the positive control and the actual delivery flow rate of the main pump 2 may be computed as a parameter representing the excess or deficiency of the delivery flow rate required for the main pump 2, and the required amount of virtual displacement change Δq of the main pump 2 may be calculated from the flow rate deviation.

Furthermore, in the above-described embodiment, the electrically driven work machine is configured such that the battery 70 and the commercial power supply 92 can be selectively used as a power supply for the electric motor 1 and that the input device 81 is used to input and set the maximum allowable power Pwmax to and in the controller 50. However, in a case where the electrically driven work machine uses one of the battery 70 and the commercial power supply 92 and can handle the maximum allowable power Pwmax as a fixed value, the maximum allowable power Pwmax can be stored and set in the controller in advance.

Additionally, in the above-described embodiment, the main pump 2 is of the variable displacement type, and horsepower control is executed by using the regulator piston 17 and the spring 18 to control the displacement of the main pump 2. However, the main pump 2 may be of the fixed displacement type, an algorithm for horsepower control may be integrated into the controller 50, and the horsepower control may be executed by the controller 50 by controlling the rotation of the electric motor 1.

Furthermore, in the above-described embodiment, the electrically driven work machine is a hydraulic excavator including crawlers in a lower track structure. However, the electrically driven work machine may be any construction machine other than the hydraulic excavator and may be, for example, a wheel type hydraulic excavator or a hydraulic crane. In that case, similar advantages are obtained.

DESCRIPTION OF REFERENCE CHARACTERS

1: Electric motor
2: Main pump of variable displacement type (hydraulic pump)
3*a* to 3*h*: Actuator
4: Control valve block (control valve device)
5: Hydraulic fluid supply line
6*a* to 6*c*: Directional control valve
7*a* to 7*c*: Pressure compensating valve
9*a* to 9*c*: Shuttle valve
17: Regulator piston
18: Spring
14: Relief valve
15: Unloading valve
15*a* and 15*c*: Pressure receiving section
15*b*: Spring
30: Pilot pump
31 and 31*a*: Hydraulic fluid supply line of a pilot pump
24: Gate lock lever
32: Pilot relief valve
40 and 41: Pressure sensor
60*a* to 60*h*: Pilot valve
50: Controller
50A: Electric motor rotation speed control section
50B: Maximum angular acceleration limitation section
50*y*: Pump flow rate estimation section
50*j*: Rate limitation section (maximum angular acceleration control section)
50*n*: Allowable rate computation section (maximum angular acceleration limitation section)
50*na*: Maximum angular acceleration calculation section
50*nb*: Maximum rate computation section
50*nc*: Hydraulic power computation section
50*nd*: Conversion parameter computation section
50*ne*: Subtractor
50*nf*: Multiplier
50*ng*: Maximum allowable power setting section
51: Reference rotation speed indication dial
60: Inverter
65: DC power supply line
70: Battery
80: Monitor
81: Input device
90: AC/DC converter
91: Connector
92: Commercial power supply

The invention claimed is:

1. A hydraulic drive system for an electrically driven hydraulic work machine, the hydraulic drive system comprising:

an electric motor;

a hydraulic pump driven by the electric motor;

a plurality of actuators driven by a hydraulic fluid delivered from the hydraulic pump;

a control valve device that distributes and feeds the hydraulic fluid delivered from the hydraulic pump to the plurality of actuators; and a controller that controls a rotation speed of the electric motor thereby to control a delivery flow rate of the hydraulic pump, wherein the controller is configured to compute a hydraulic power consumed by the hydraulic pump, compute a maximum angular acceleration allowed for the electric motor on a basis of the hydraulic power consumed by the hydraulic pump and a preset maximum allowable power consumable by the electric motor, and limit an angular acceleration of the electric motor not to exceed the maximum angular acceleration, and control the rotation speed of the electric motor.

2. The hydraulic drive system for an electrically driven hydraulic work machine according to claim 1, wherein the controller is configured to subtract, from the maximum allowable power, the hydraulic power consumed by the hydraulic pump to compute an allowable acceleration power consumable for acceleration by the electric motor and compute the maximum angular acceleration on a basis of the allowable acceleration power.

3. The hydraulic drive system for an electrically driven hydraulic work machine according to claim 1, wherein the controller is configured to calculate a required amount of virtual displacement change of the hydraulic pump depending on excess or deficiency of a delivery flow rate of the hydraulic pump, and compute a maximum amount of virtual displacement change allowed for the hydraulic pump from the maximum angular acceleration allowed for the electric motor and limit the required amount of virtual displacement change of the hydraulic pump not to exceed the maximum amount of virtual displacement change thereby to limit the angular acceleration of the electric motor not to exceed the maximum angular acceleration, and control the rotation speed of the electric motor.

4. The hydraulic drive system for an electrically driven hydraulic work machine according to claim 3, wherein the controller is configured to calculate a differential pressure deviation between a target differential pressure for load sensing control and a differential pressure between the delivery pressure of the hydraulic pump and a maximum load pressure of the plurality of actuators, calculate the required amount of virtual displacement change of the hydraulic pump on a basis of the differential pressure deviation, and execute the load sensing control to make the delivery pressure of the hydraulic pump higher than the maximum load pressure by the target differential pressure, and limit the required amount of virtual displacement change of the hydraulic pump computed on the basis of the differential pressure deviation not to exceed the maximum amount of virtual displacement change.

5. The hydraulic drive system for an electrically driven hydraulic work machine according to claim 1, further comprising:

an input device for inputting the maximum allowable power consumable by the electric motor and setting the input maximum allowable power in the controller.

* * * * *